US008550289B1

(12) United States Patent
Gibbar

(10) Patent No.: US 8,550,289 B1
(45) Date of Patent: Oct. 8, 2013

(54) DRINK VESSEL HOLDER

(76) Inventor: James M. Gibbar, Colorado Springs, CO (US)

( * ) Notice: Subject to any disclaimer, the term of this patent is extended or adjusted under 35 U.S.C. 154(b) by 19 days.

(21) Appl. No.: 13/374,088

(22) Filed: Dec. 12, 2011

Related U.S. Application Data

(63) Continuation-in-part of application No. 10/252,181, filed on Sep. 23, 2002, now Pat. No. 8,302,806.

(51) Int. Cl.
*B65D 3/28* (2006.01)

(52) U.S. Cl.
USPC ..... 220/738; 220/737

(58) Field of Classification Search
USPC ..... 220/737, 738, 739, 592.16, 592.17; 248/346.11
See application file for complete search history.

(56) References Cited

U.S. PATENT DOCUMENTS

| | | | | |
|---|---|---|---|---|
| 2,163,309 | A * | 6/1939 | McConnell | 215/394 |
| 2,591,374 | A * | 4/1952 | Place | 215/371 |
| 5,413,302 | A * | 5/1995 | Ferster | 248/346.11 |
| 7,124,604 | B2 * | 10/2006 | Taylor et al. | 62/457.4 |
| 8,162,170 | B1 * | 4/2012 | Massad | 220/739 |

* cited by examiner

*Primary Examiner* — Anthony Stashick
*Assistant Examiner* — Christopher McKinley
(74) *Attorney, Agent, or Firm* — Peter Loffler

(57) ABSTRACT

A drink vessel holder holds a drink vessel on a target surface such as a plate of food and allows the user to hold both the plate and the drink vessel held thereon with the same hand in order to allow the other hand to be used for enjoyment of the products being held. The drink vessel holder has a body member with a convex upper surface that seats within a concave bottom surface of a drink vessel. A tab extends outwardly from the body member, the tab being used by the user to hold the drink vessel on the plate. The tab may have an arcuate channel that receives a portion of the bottom structural ring of the drink vessel or the structural ring may be depressed or slotted for passage of the tab therethrough.

20 Claims, 7 Drawing Sheets

DRINK VESSEL HOLDER

This application is a Continuation-In-Part of U.S. patent application Ser. No. 10/252,181, filed on Sep. 23, 2002 now U.S. Pat. No. 8,302,806, which application is incorporated in its entirety herein by reference

BACKGROUND OF THE INVENTION

1. Field of the Invention

The present invention relates to a device that holds a drink vessel which can rest on a plate or other surface allowing the user to maintain the drink vessel securely thereon with one hand freeing the other hand. The present invention works specifically with a drink vessel that has a generally concave bottom, such as beverage can as well as certain glass and stem ware.

2. Background of the Prior Art

Most parties and other similar social occasions serve both food and drink. Obviously, the food is placed onto a plate while the drink is held within a drink vessel such as a can, or a glass, either a drink glass or a wine glass. This very straightforward holding method, while very efficient in its containment performance, does have its drawbacks.

If the social occasion is such that food and drink are retrieved from one or more central serving stations, and upon retrieval of the bounty, the user returns to a seat at a table, the separate plate and drink vessel tend to be satisfactory for most such occasions—also efficient for being served. The problem arises when it is desired that the party attendee not return to a table for consumption of the food and drink being served. Such lack of a desired destination can occur when the party host lacks sufficient sit down facilities to accommodate all of the guests. This typically occurs when it is the host's desire to keep the attendees on their feet in order to keep the attendees circulating in order to facilitate dynamic guest interaction.

As the guest must hold the food filled plate with one hand and the drink vessel with the other, this desire to keep a large portion of the guests circulating at any given time, presents some problems. Although sipping a drink presents few problems, having both hands full makes the consumption of the food on the plate a tricky occurrence. The guest may sit at a table to consume both food and drink in relative comfort. However, either by necessity or by design, the availability of sitting locations may be at a premium and many guests do not want to sit down desiring to mingle even while eating and drinking. The guest may find a location, such as a table, onto which either the plate or the drink vessel may be placed, thereby freeing one hand allowing for proper maneuverability between plate and drink vessel. However, this may also be problematic due to the limited availability, either by necessity or by design, of such rest areas available to the guest. Furthermore, this method also tends to tie down the guest to a specific location, although not necessarily as much as sitting at a table.

Another method used to overcome the problem of having both hands full, is for the guest to retrieve their food or drink initially, and upon consumption of the initial item, to retrieve the other item in order to consume food and drink in sequential fashion. While this method works as planned, most guests desire to have a drink during, as opposed to before or after, food consumption. Additionally, this arrangement throws into disarray parties that are designed for the intermingling of food and drink such as wine and cheese parties or beer and pretzel parties.

One other method employed by many guests is to attempt to hold the food plate and the drink vessel with one hand and to use the other hand to facilitate enjoyment of the consumables. While many guests may prove to be quite adept at succeeding with such maneuverability, other guests will proceed with disastrous and embarrassing results.

In order to facilitate the ability of a guest to be able to enjoy food and drink simultaneously without the need to sit at a table or to place either the food bearing plate or the drink vessel onto a fixed surface and without the need to perform heroic acrobatics, combined plate and drink vessel holders have been proposed. Such prior art devices are designed to serve as a plate in order to hold food and are also designed to hold a drink vessel securely so that a user can hold the food bearing plate and drink vessel with one hand in order to allow the other hand to be available to facilitate the enjoyment of the food and drink. Such prior art devices come in a variety of designs and work with varying degrees of efficiency, however, they tend to suffer from one or more drawbacks.

Many such food plate and drink vessel holding devices perform their intended task with great efficiency, yet such devices are unduly complex in design and construction, making such devices unusually expensive to employ. As these devices tend to be disposable, a high cost device is unjustified in most settings. Other prior art devices have the ability to hold only a specific type or specific size of drink vessel, making the utility of such devices limited in many situations. Still other devices require certain steps to be taken for proper device usage, which steps may not be obvious to a guest who has not encountered such a device previously, rendering such devices awkward in operation with the potential for device failure and the attendant embarrassment that results.

My previous U.S. Pat. No. 6,609,625, issued on Aug. 28, 2003, has resolved many prior art problems while my continued work in this field has produced an ever expanding set of device solutions to the need to be able to hold a plate and a drink vessel with a single hand in order to allow the use of the other hand for consumption efforts from the plate and vessel.

SUMMARY OF THE INVENTION

The drink vessel holder of the present invention continues to solve the aforementioned shortcomings found in the art. The drink vessel holder is a device that allows a user to hold a drink vessel on a target surface, such as a plate, with the one hand so that the other hand may be employed to enjoy both food and drink. The drink vessel holder is of relatively simple and straightforward design and construction and is relatively easy to manufacture, employing standard manufacturing techniques for its production. The drink vessel holder is designed for drink vessels that have a relatively concave bottom surface, such as soda and beer cans, certain glass ware and wine glasses, which vessels represent a large segment of the overall drink vessel universe, at least as is concerned with typical social gatherings whereat the present invention is targeted for deployment. My present invention is quick and easy to deploy and use, even to a device novice, rendering the chance for potential disaster during device usage relatively small.

The drink vessel holder of the present invention is comprised of a circular body member having a convex first upper surface and a matching concave first lower surface, the curvature of convexity of the first upper surface corresponding to the curvature of concavity of a bottom surface of a target drink vessel. A tab has a second upper surface and a relatively flat second lower surface and extends outwardly from the body member. The first upper surface of the body member is attached to the bottom surface of the drink vessel, and the second lower surface of the tab rests on a target surface (plate, serving tray, counter, etc.) with a user's thumb or finger resting on the second upper surface of the tab in order to press the second lower surface of the tab onto the target surface in order to help stabilize the drink vessel on the plate. The body member and the tab may be unitary in construction and may even be monolithic in construction. An arcuate channel may be disposed within the second upper surface of the tab such that the structural ring of the drink vessel seats within the channel whenever the body member is attached to the drink vessel. An adhesive layer may be disposed atop the first upper surface of the body member with a peel away protective membrane positioned atop the first upper surface it order to protect the adhesive layer. The body member and tab are made from an appropriate thin, flexible material such as plastic, rubber, silicone, aluminum, paper (including cardboard), etc.

BRIEF DESCRIPTION OF THE DRAWINGS

Similar reference numerals refer to similar parts throughout the several views of the drawings.

DESCRIPTION OF THE PREFERRED EMBODIMENT

Figure 1:
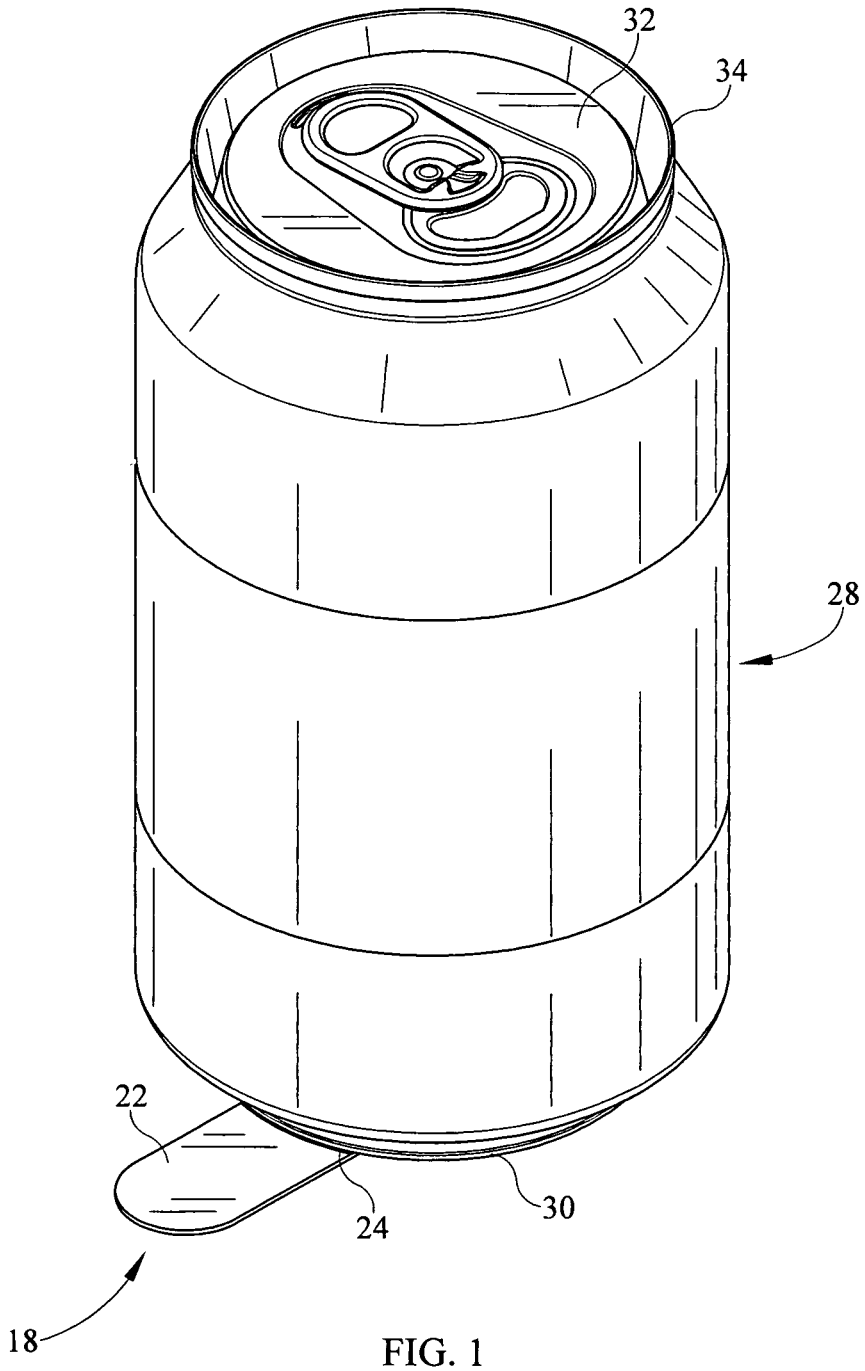
FIG. 1 is a perspective view of the drink vessel holder of the present invention, deployed on a typical beverage can (beer, soda, etc.).

Referring now to the drawings, it is seen that the drink vessel holder of the preseat invention, generally denoted by reference numeral 10, is comprised of a generally disk shaped body member 12 having a concave lower surface 14 (although the lower surface may also be relatively flat) and a convex upper surface 16 that corresponds to the concavity of the lower surface 14, if so configured. A tab 18, also having a relatively flat lower surface 20 and an upper surface 22, extends outwardly from a side of the body member 12, such that the body member 12 and the tab 18 are unitary and possibly even monolithic in construction. An optional arcuate channel 24 is disposed within the upper surface 22 of the tab 18. The body member 12 and tab 18 are made from an appropriate flexible material such as flexible plastic, rubber, silicone, aluminum, paper (including cardboard), etc., although the drink vessel holder 10 can also be made from a relatively rigid material within the scope and spirit of the invention The drink vessel holder 10 of the present invention is designed to be attached to the bottom surface 26 of a beverage vessel 28 such as the illustrated can, the can 28 being generally cylindrical in shape and having the bottom surface 26 encompassed by a structural ring 30 and a top surface 32 also having a structural ring 34 and a tabbed opening 36 for dispensing of the fluid held within the can 28. As seen, the bottom surface 26 of the can 28 is generally concave with a curvature of concavity corresponding to the curvature of convexity of the upper surface 16 of the body member 12. It is expressly recognized that beverage holders other than the illustrated beverage can 28 can be used with the drink vessel holder 10 of the present invention. For example, many glasses, such as high ball glasses, simple water glasses, wine glasses, etc., also have a generally concave lower surface.

In its simplest iteration, the body member 12 is attached to the drink vessel 28 such that the convex upper surface 16 of the body member 12 is received within the concave bottom surface 26 of the beverage can 28. Attachment of body member 12 to bottom surface 26 of can 28 can be as simple as a frictional attachment. However, as many drink vessels, especially cans 28, tend to be cold and therefore have a condensation layer on their outer surface, including the bottom surface 26, the upper surface 16 may have an adhesive layer thereon for facilitating adhesive attachment of body member 12 to can (vessel) 28. Advantageously, such an adhesive allows bonding of the body member 12 to a relatively wet surface 26 of the beverage vessel 28. The peel strength of the adhesive material is sufficiently high so as to maintain firm adhesive contact with its respective device 28, even if moisture is present. If an adhesive layer is provided on the upper surface 16 of the body member 12, then an appropriate protective membrane 38 overlays the upper surface 16 of the body member 12 and is peeled off therefrom when the device 10 is ready to be attached to the drink vessel 28.

Figure 2:
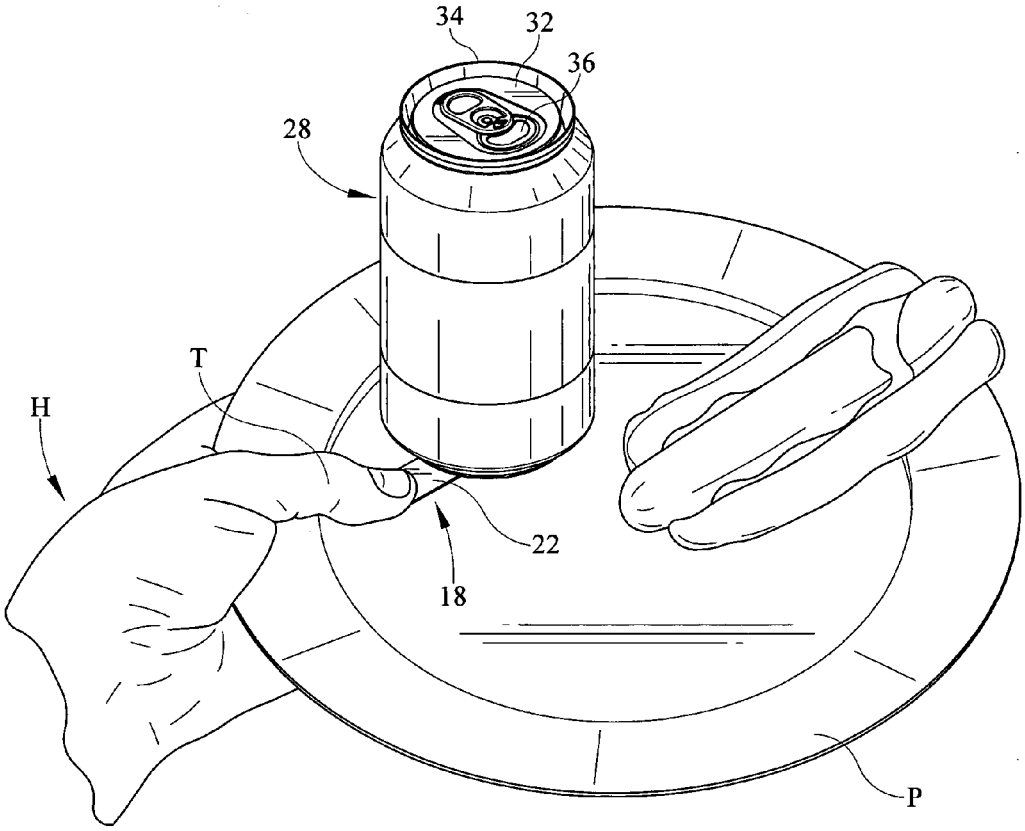
FIG. 2 is a perspective view of the drink vessel holder in use holding the beverage can on a plate.
Figure 3:
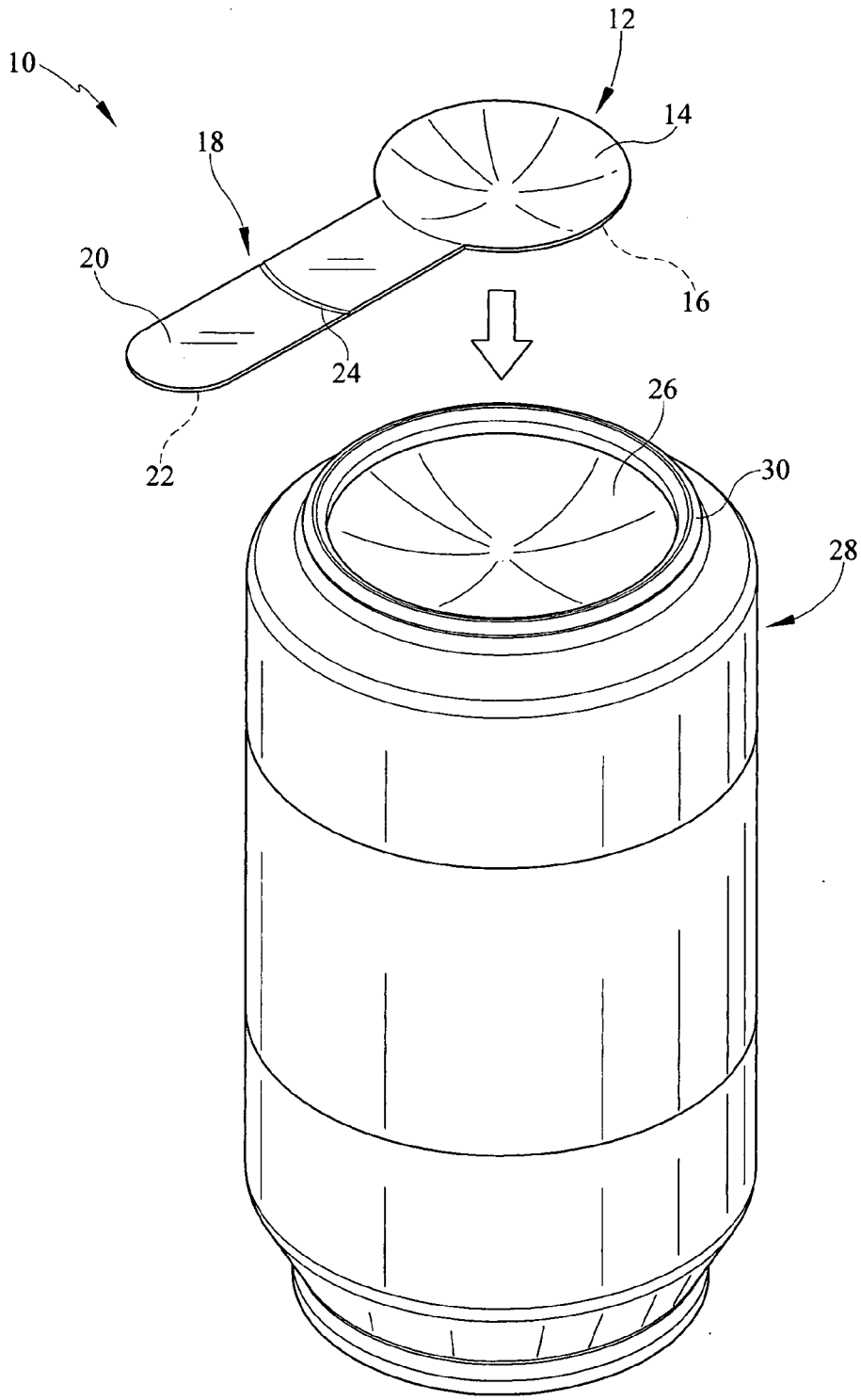
FIG. 3 is a bottom perspective view of the drink vessel holder being positioned onto the bottom of the beverage can.

After the body member 12 is attached to the beverage vessel 28, the tab 18 is extended outwardly (if not already so positioned). The tab 18 is dimensioned so that it extends beyond the outer perimeter of the beverage vessel 28. The beverage vessel 28 is placed upon a flat surface, such as the plate P illustrated in FIG. 2, and the user uses his or her thumb T of the hand H holding the plate P to press the tab 18 onto the plate P in order to steady the beverage vessel 28 on the plate P. This allows the user to hold the plate P and the beverage vessel 28 with a single hand H.

If the channel 24 is present on the upper surface 22 of the tab 18, the radius of curvature of the channel 24 matches the radius of curvature of the structural ring 30 of the beverage vessel 28 and is positioned on the tab 18 so that the structural ring 30 of the beverage vessel 28 seats within the channel 24 whenever the body member 12 is centrally attached to the bottom surface 26 of the beverage vessel 28. This seating helps hold the beverage vessel 28 on the plate P. If the channel 24 is not present within the tab 18, then the tab 18, by being resilient due to the materials used to produce the tab 18, allows the structural ring 30 to be pressed into the upper surface 22 of the tab 18 for added securement of the beverage vessel 28 being held by the device 10.

Figure 6:
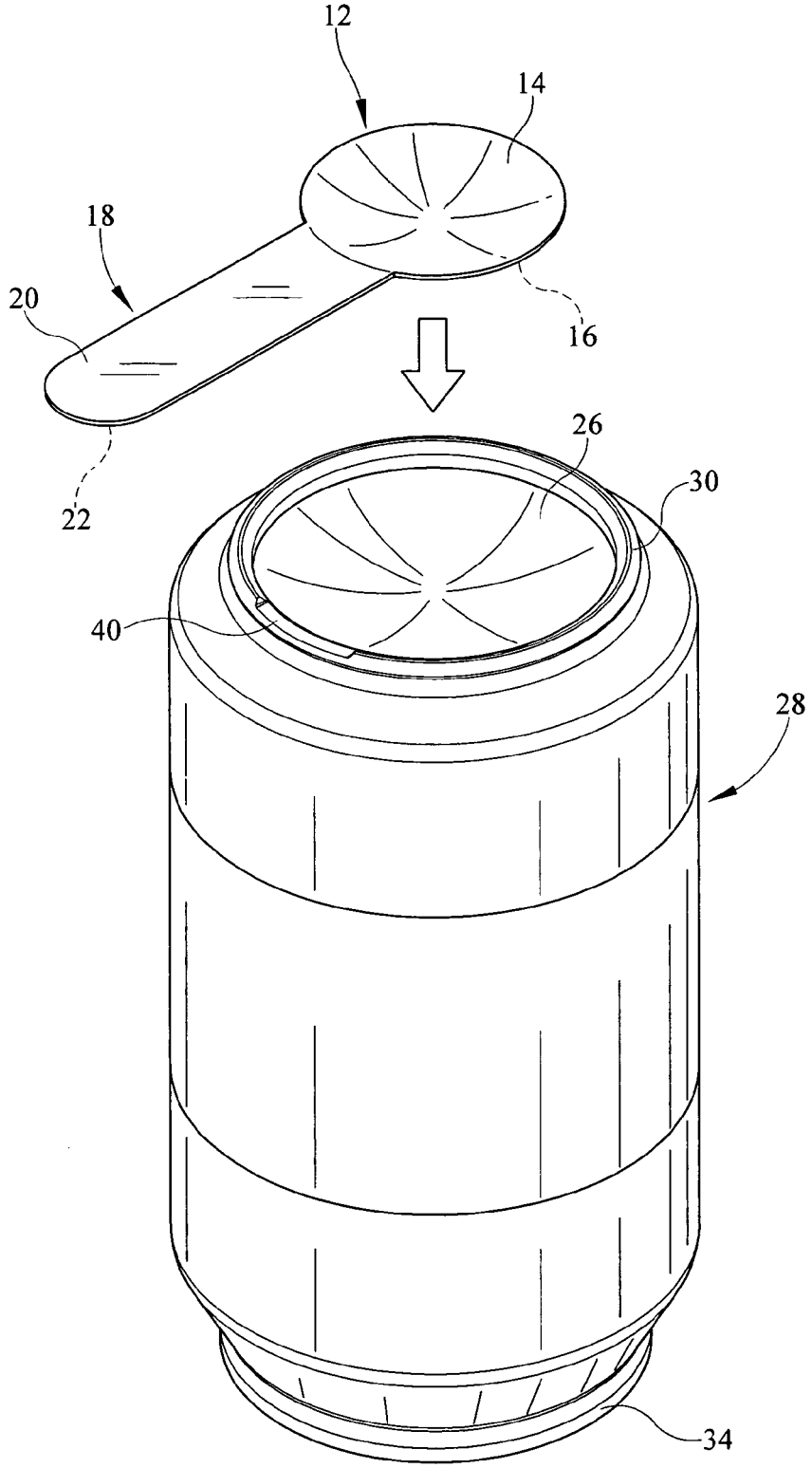
FIG. 6 is a bottom perspective view of the drink vessel holder being positioned onto the bottom of the beverage can wherein the can is configured for use of the drink vessel holder.

Alternately, as seen in FIG. 6, the can 28 can be modified so that a portion of the structural ring 30 proximate the bottom surface 26 of the can 28, has a depression 40 (or alternately slotted (not illustrated)) in order to allow the tab 18 to pass therethrough. The structural ring 30 should not be completely eliminated at this area in order to preserve the structural integrity of the can 28.

Figure 4A:
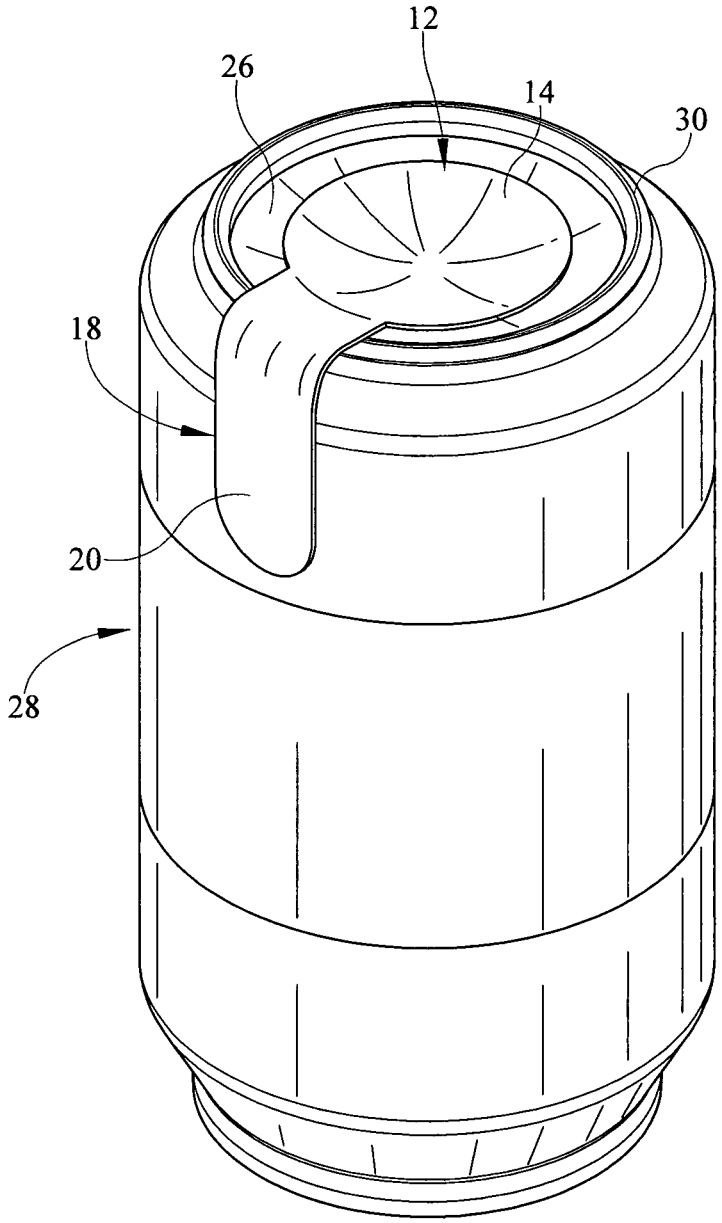
FIG. 4A is a bottom perspective view of the drink vessel holder attached to the bottom of the beverage can, the drink vessel holder is in a stored, ready to be deployed position.
Figure 4B:
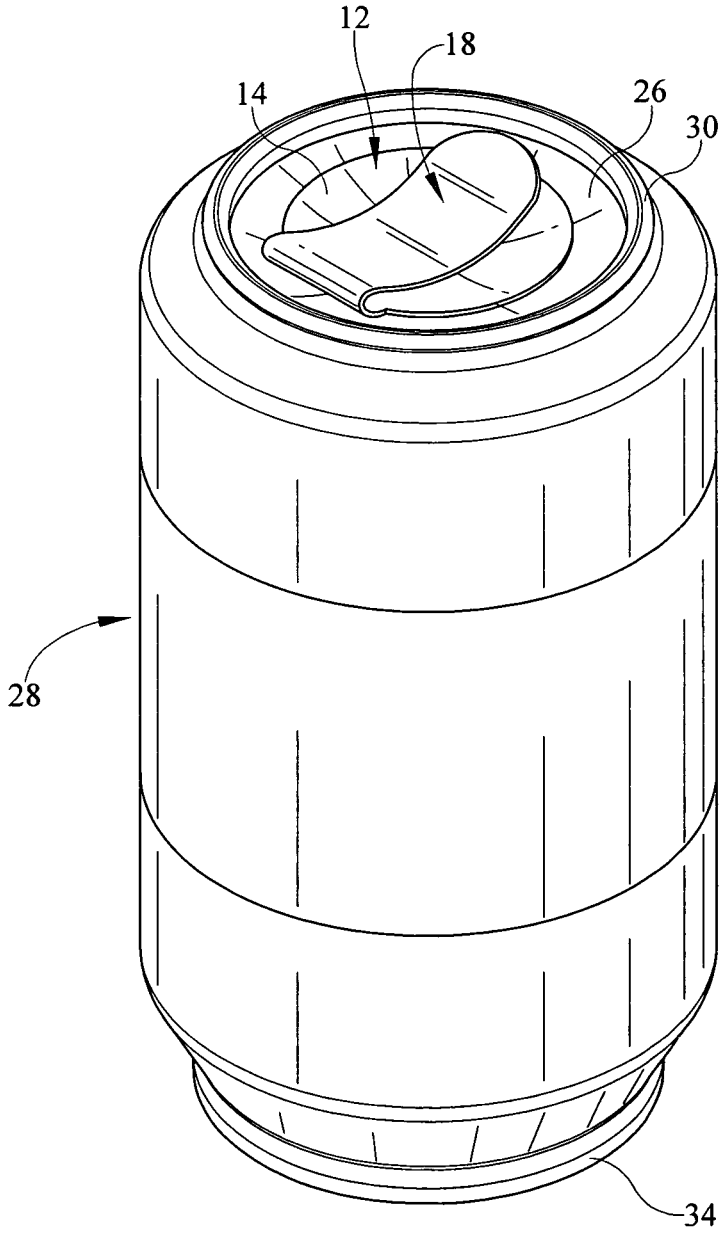
FIG. 4B is a bottom perspective view of the drink vessel holder attached to the bottom of the beverage can, the drink vessel holder is in a second stored, ready to be deployed position.
Figure 5:
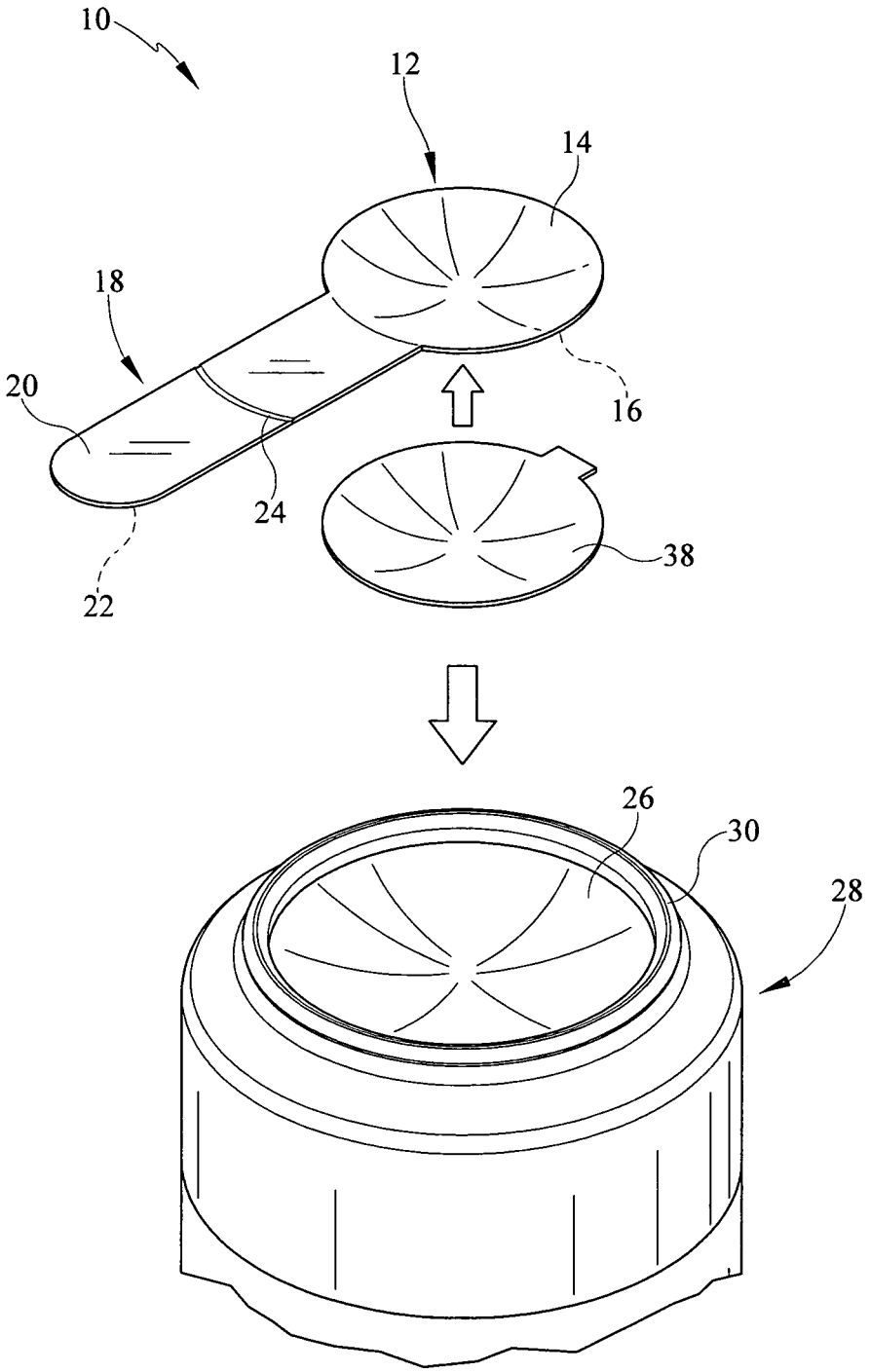
FIG. 5 is a bottom perspective view, exploded, of the drink vessel holder being positioned onto the bottom of the beverage can and illustrating the removal of the protective membrane.

The drink vessel holder 10 of the present invention can be packaged and sold independently of the beverage vessel 28 onto which the device 10 is to be attached and deployed as desired. Alternately, the beverage vessel 28 can come equipped with the drink vessel holder 10 pre-installed by the manufacturer of the vessel 28, as illustrated in FIG. 4A, or the tab 18 can be folded, or curled back against the body member as illustrated in FIG. 4B. Pre-installation of the drink vessel holder 10 by the manufacturer of the beverage can 28 may call for the use of an appropriate adhesive to attach the convex upper surface 16 of the body member 12 to the concave bottom surface 26 of the beverage can 28, or, if the drink vessel holder 10 is made of thin flexible aluminum, the upper surface 16 may be spot welded or riveted to bottom surface 26 as an alternative to using an adhesive.

Once use of the beverage vessel 28 is no longer needed, then the drink vessel holder 10 is either left on the beverage vessel 28, with both being discarded, or the drink vessel holder 10 is detached from the previous beverage vessel 28 and placed upon a new beverage vessel 28 as desired.

While the invention has been particularly shown and described with reference to embodiments thereof, it will be appreciated by those skilled in the art that various changes in form and detail may be made without departing from the spirit and scope of the invention.

I claim:

1. A drink vessel holder for attachment to a drink vessel, the drink vessel having a concave bottom surface encompassed by a circular structural ring, the drink vessel holder comprising:

a circular body member having a convex first upper surface and either a corresponding concave first lower surface or a relatively flat first lower surface, the curvature of convexity of the first upper surface corresponding to the curvature of concavity of the bottom surface of the drink vessel, the body member having an outer periphery;

a bullet-shaped tab having a second upper surface and a relatively flat second lower surface, extending radially outwardly from only a minority portion of the outer periphery of the body member;

wherein the first upper surface of the body member is adapted to be attached to the bottom surface of the drink vessel such that the entire outer periphery of the body member is confined within the circular structural ring so that the structural ring does not rest on the body member, and the second lower surface of the tab is adapted to rest on a target surface with a force being placed onto the second upper surface in order to press the second lower surface onto the target surface.

2. The drink vessel holder as in claim 1 wherein the body member and the tab are unitary in construction.

3. The drink vessel holder as in claim 2 wherein the body member and the tab are monolithic in construction.

4. The drink vessel holder as in claim 3 further comprising an arcuate channel disposed within the second upper surface of the tab such that a portion of the structural ring of the drink vessel is adapted to seat within the channel whenever the body member is attached to the drink vessel.

5. The drink vessel holder as in claim 4 further comprising an adhesive layer disposed atop the first upper surface of the body member.

6. The drink vessel holder as in claim 5 further comprising a peel away protective membrane positioned atop the first upper surface in order to protect the adhesive layer.

7. The drink vessel holder as in claim 1 further comprising an arcuate channel disposed within the second upper surface of the tab such that a portion of the structural ring of the drink vessel is adapted to seat within the channel whenever the body member is attached to the drink vessel.

8. The drink vessel holder as in claim 1 further comprising an adhesive layer disposed atop the first upper surface of the body member.

9. The drink vessel holder as in claim 8 further comprising a peel away protective membrane positioned atop the first upper surface in order to protect the adhesive layer.

10. The drink vessel holder as in claim 1 in combination with the drink vessel.

11. The drink vessel holder as in claim 10 wherein the body member and the tab are unitary in construction.

12. The drink vessel holder as in claim 11 wherein the body member and the tab are monolithic in construction.

13. The drink vessel holder as in claim 12 further comprising an arcuate channel disposed within the second upper surface of the tab such that a portion of the structural ring of the drink vessel is adapted to seat within the channel whenever the body member is attached to the drink vessel.

14. The drink vessel holder as in claim 13 further comprising an adhesive layer disposed atop the first upper surface of the body member.

15. The drink vessel holder as in claim 14 further comprising a peel away protective membrane positioned atop the first upper surface in order to protect the adhesive layer.

16. The drink vessel holder as in claim 15 wherein the structural ring has either a depression or a slot such that the tab passes over the depression or through the slot.

17. The drink vessel holder as in claim 10 further comprising an arcuate channel disposed within the second upper surface of the tab such that a portion of the structural ring of the drink vessel is adapted to seat within the channel whenever the body member is attached to the drink vessel.

18. The drink vessel holder as in claim 10 further comprising an adhesive layer disposed atop the first upper surface of the body member.

19. The drink vessel holder as in claim 10 further comprising a peel away protective membrane positioned atop the first upper surface in order to protect the adhesive layer.

20. The drink vessel holder as in claim 19 wherein the protective structural ring has either a depression or a slot such that the tab passes over the depression or through the slot.

* * * * *